US006796857B2

(12) United States Patent
Tornblad et al.

(10) Patent No.: US 6,796,857 B2
(45) Date of Patent: Sep. 28, 2004

(54) PROPULSION SYSTEM FOR A SHIP

(75) Inventors: Jens Tornblad, Kristinehamn (SE); Christer Häger, Kristinehamn (SE); Sven-Gunnar Karlsson, Kristinehamn (SE); Gunnar Styrud, Kristinehamn (SE)

(73) Assignee: Rolls-Royce Aktiebolag, Kristinehamn (SE)

( * ) Notice: Subject to any disclaimer, the term of this patent is extended or adjusted under 35 U.S.C. 154(b) by 0 days.

(21) Appl. No.: 10/297,300

(22) PCT Filed: Jun. 7, 2001

(86) PCT No.: PCT/SE01/01292

§ 371 (c)(1),
(2), (4) Date: Dec. 4, 2002

(87) PCT Pub. No.: WO01/94196

PCT Pub. Date: Dec. 13, 2001

(65) Prior Publication Data

US 2003/0153217 A1 Aug. 14, 2003

(30) Foreign Application Priority Data

Jun. 7, 2000 (SE) ..... 0002140

(51) Int. Cl.[7] ..... B63H 11/00
(52) U.S. Cl. ..... 440/38; 440/83; 440/112
(58) Field of Search ..... 440/38, 47, 83, 440/112

(56) References Cited

U.S. PATENT DOCUMENTS

| | | | | |
|---|---|---|---|---|
| 5,045,002 A | | 9/1991 | Torneman et al. | 440/38 |
| 5,060,765 A | * | 10/1991 | Meyer | 188/71.9 |
| 5,713,727 A | | 2/1998 | Veronesi et al. | 417/356 |
| 5,737,997 A | * | 4/1998 | Sato et al. | 92/71 |
| 6,053,783 A | | 4/2000 | Brunn | 440/78 |

FOREIGN PATENT DOCUMENTS

| | | |
|---|---|---|
| NO | 124674 | 5/1972 |
| SE | 504 604 | 3/1997 |
| WO | WO 97/26183 | 7/1997 |

OTHER PUBLICATIONS

English Language Abstract of JP 11070894 Dated Mar. 16, 1999, Copy of International Search Report.

* cited by examiner

*Primary Examiner*—Stephen Avila
(74) *Attorney, Agent, or Firm*—Michael D. Bednarek; Shaw Pittman LLP

(57) ABSTRACT

The invention comprises a propulsion system for ships comprising an impeller (13, 14), a stator shell (1), and a impeller housing (3) for achieving a waterjet, a shaft (11, 12) for the propulsion of the impeller (13), and a bearing arrangement for the shaft (11, 12) in the stator shell (1), and preferably a sealing (15) of the shaft (11, 12) in the impeller housing (3), wherein said bearing arrangement comprises at least one sliding bearing unit (25; 26) intended to carry axial load, and which sliding bearing preferably is water lubricated.

10 Claims, 3 Drawing Sheets

PROPULSION SYSTEM FOR A SHIP

This application is a 371 a PCT/SE01/01292 filed Jun. 7, 2001.

TECHNICAL FIELD

The present invention relates to a propulsion system for ships, which propulsion system comprises one or several impellers mounted on one shaft each, which impeller/s establishes/establish a force that drives the ship forward. The impeller, being rotatable in an impeller house by means of the driving shaft, is provided with blades of the propeller type, which produce the jet stream backwards.

PRIOR ART AND PROBLEMS

The propulsion of ships, preferably fast moving ships, both military and civilian ones, through water jet arrangement, comprising impellers are generally known. The housing surrounding the rotating impeller provided with blades is fixedly mounted to the rear portion of the hull. The impeller is typically driven by a steel shaft extending towards the stem by suitable arrangements which in turn are driven by one or several engines within the hull. A tube-like water inlet, which slopes somewhat downwards in the moving direction, is provided in front of the impeller housing in order to supply a large amount of water. The driving shaft thus runs through said tubular water inlet. The ship is controlled by means of steering devices downstream the impeller housing (or housings), which may direct the jet stream in different directions. The jet stream may also be directed forwards to give a decelerating effect.

As the driving shaft of the impeller extends through the water inlet, the incoming flow of water to the impeller is disturbed to some extent, which implies that an unevenly distributed load on the blades of the impeller is created. Said uneven load implies that a bending moment is transferred to the impeller inwards towards the attachment point of the impeller. Because of these varying forces influencing the impeller and its attachment point, very high requirements are put on the arrangement of the bearings and sealings. It is known from SE 424 845 to solve said problem by arranging the impeller fixedly mounted to the shaft and to arrange a bearing arrangement allowing a certain angle deviation. However, said solution is relatively heavy, especially since it requires a design with a bending rigid driving shaft (in order not to risk too great angle deviations), which shaft thus is very heavy. It is not unusual that only the weight of the driving shaft in such a design amounts to about 10% of the total weight of the water jet device (including the weight of the of the pump unit including stator part with guide vanes, thrust and journal bearing arrangement, impeller and impeller housing and the steering and reversing gear).

Another known solution is shown in SE 457 165 and SE 504 604, wherein a bearing arrangement is used which cannot handle angle deviations and wherein a flexible coupling between the driving shaft and the impeller is used instead, the flexible coupling being intended to handle the angle deviations. Also said last mentioned solution leads to a heavy design, especially since the coupling as such implies an additional weight. Further, it implies a drawback as the coupling is provided at a critical position as to flow, which makes it difficult to obtain optimal flow conditions. Moreover, the coupling implies a power limitation. It is realized that a detail which limits the power transmission is not desirable in such applications, as, especially with such applications, it many times is desirable to be able to transfer a lot of power, often in the interval of 3–30 MW. The design according to SE 504 604 instead shows the use of a flexible coupling and is directed to an embodiment, which makes it possible to dismount the bearing unit backwards. This implies i.a. that the guide vanes, which transmit the force from the impeller to the stator shell, must have a very limited extension. For long it has been a desire to reduce the weight in order to increase the power density (with power density is meant the maximal power output divided with the weight of the water jet unit, comprising the weight of the pump unit including stator part with guide vanes, thrust and journal bearing arrangement, impeller and impeller housing and the steering and reversing gear). With known designs it is probably difficult to achieve a power density above 1 kW/kg for a water jet having an inlet diameter above 1 m, which is an undesired and serious limitation. As is evident for the skilled man the power density for the same kind of design does decrease with increased size.

THE SOLUTION

An objective of the invention is to find an optimal solution of the above described complex of problems. Said objective is achieved by a driving system for propulsion of a ship comprising an impeller, a stator shell, and an impeller housing for the achievement of a water jet, a shaft for driving the impeller and a bearing arrangement for the shaft in the stator shell, wherein said bearing arrangement comprises at least one, sliding bearing unit intended to carry axial load, and which sliding bearing preferably is water lubricated.

Thanks to said design a cost-efficient solution is obtained which provides for weight reduction and for obtaining high power density. Furthermore, the design may meet heavy demands on operation safety during extreme conditions in certain respects.

According to further aspects of the invention:

said shaft comprises a shaft journal with a flange means showing at least an axial surface intended for the interaction with a sliding bearing;

the flange means is provided with two opposite surfaces interacting with a front and a rear axial sliding bearing, respectively;

there is a front and rear axial sliding bearing and that said front sliding bearing has a considerably larger surface than said rear sliding bearing, wherein preferably the surface of the front bearing is at least 1.5 times as large as the surface of the rear bearing;

said bearing arrangement comprises a radial sliding bearing, which is preferably provided rear of at least one axial bearing unit; and a conduit system for the supply of a lubricant to said sliding bearing arrangement, wherein preferably at least one of said conduits is provided in a guide vane.

According to another preferred aspect of the invention, the shaft consists of a low weight shaft, which has considerably lower bending rigidity than a conventional steel shaft.

Because of the use of a light weight shaft, which becomes comparatively weak as to bending, conditions are created to use a bearing arrangement which is rigid with reference to bending moments and which handles an axial load and at the same time has non-flexible couplings (e.g. fixedly attached by screws) between the impeller and the end portion of the driving shaft. At the same time, the comparatively weak driving shaft meet the objective to achieve a weight reduction. Further, it makes a cost saving possible with reference to the shaft as the choice of material is optimised in this respect. The shaft may thus be made comparatively slender, and because of the preferred attachment directly against the impeller, optimal conditions are obtained to create as good flow paths as possible, which in turn may imply reduced bending forces influencing the bearing arrangement of the impeller.

According to a preferred embodiment of such a driving system, the driving shaft consists at least mainly of a composite material. Above all, a composite shaft has the great advantage that very low weights may be obtained. A weight reduction of up to 70% as compared to a conventional steel shaft is possible. Further, the advantage is obtained that a composite shaft is exceptionally bendable, which is an advantage with reference to the bearing arrangement. A low bending rigidity is also desirable and a composite shaft may give a reduction of the bending rigidity of about 80% as compared to a conventional, homogenous steel shaft.

According to further potential aspects:

said light weight shaft is made of metal, preferably titanium and/or a hollow steel shaft;

the driving force is transmitted by at least one non-flexible coupling to the stator shell;

the inlet diameter D of said impeller housing is between 0,5–2 m and that the power density is at least 0,5+(2–D) kW/kg, there is no flexible coupling for the transmission of power from the shaft to the impeller.

Thanks to the invention, it is possible, as compared to conventional systems, to build a substantially much lighter driving system for a water-jet driven ship, which system at the same time provides for a high reliability in operation.

DESCRIPTION OF DRAWINGS

The invention will be described more in detail with reference to the accompanying drawing, of which.

DETAILED DESCRIPTION OF THE INVENTION

Figure 1:
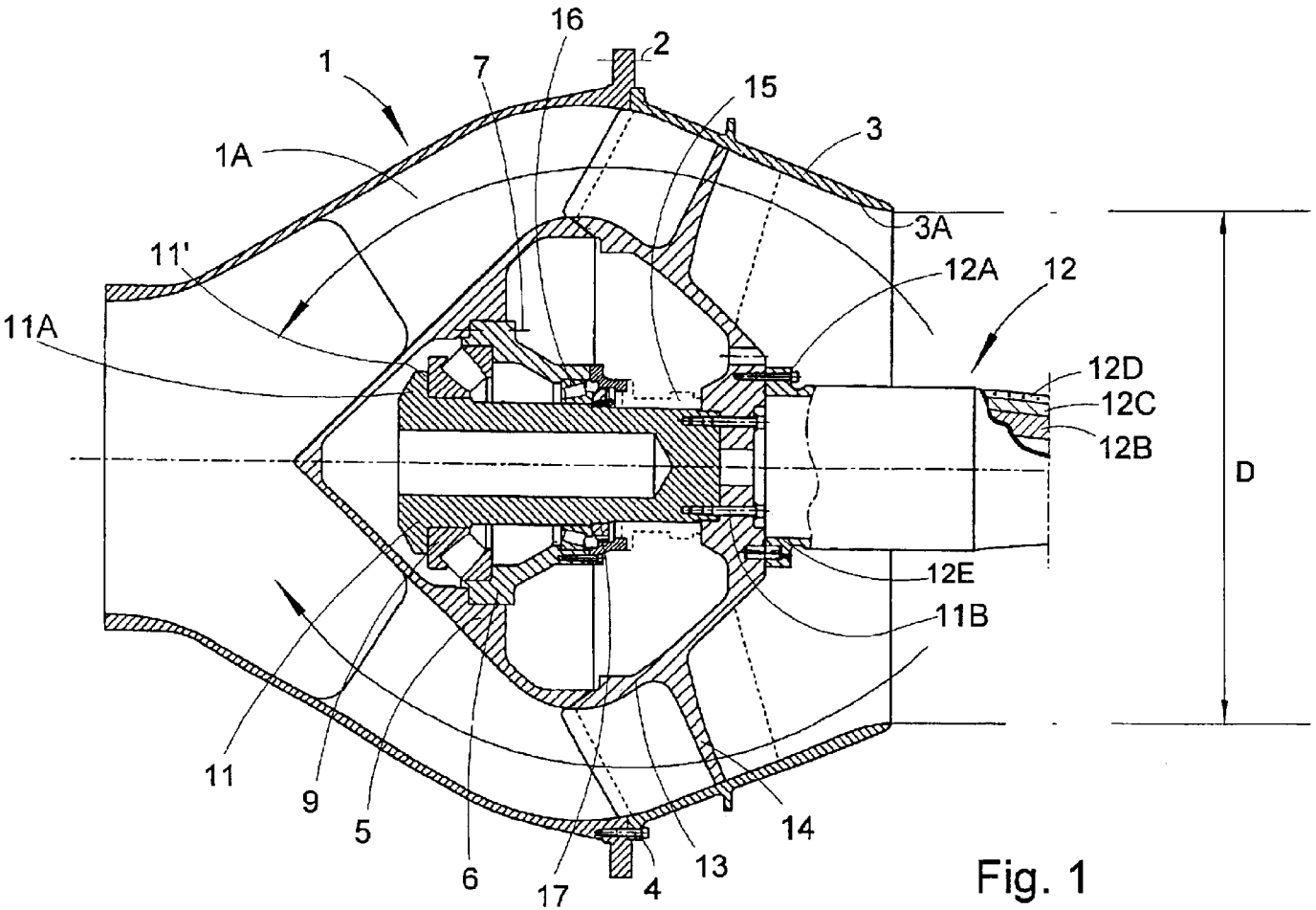
FIG. 1 is a vertical, axial cross section of an impeller and an impeller housing according to a preferred embodiment.

FIG. 1 shows an impeller device in a vertical section according to the invention. A stator shell 1 is fixedly mounted to the rear portion of the hull by bolts 2 or the like. An impeller housing 3, in the form of a conical front portion, is mounted to the stator portion 1 by screws 4 or the like. The inlet of said front portion (having a certain diameter D) of the impeller housing 3 is aligned to a tubular water inlet extending forwards, which is known per se (not shown). The shaft journal 11 is in relation to turning and bending fixedly connected to the shaft 12 by means of a first coupling 11B via a rotating impeller base 13.

A conically shaped housing 5, with its tip directed backwards, is through non-rotating guide vanes 1A fixedly secured within the stator shell 1. There is a bearing seat 6 within said housing 5, which seat is mounted by screws 7 approximately in the middle of the housing and which seat is intended to support a bearing arrangement 9, 16 for a shaft journal to the driving shaft 12. For allowing water to be evacuated from the inner of the housing 5/base 13 there is a set of drainage holes 13A arranged comparatively near the centre (where the pressure is relatively low) of the front impeller base 13.

The rotating impeller 13, 14 is via a second fixedly attached (non-turnable and bending rigid) coupling 12A, suitably a screw connection, fixedly mounted about the shaft journal 11. Thus, said impeller 13, 14 rotates together with the shaft 12, and impeller blades 14 are provided on said base 13. Said impeller blades 14 create the water jet flow which is directed backwards and which is shown by arrows. Said backwards directed water jet flow causes via the impeller 13, 14 a forwards directed recoil force in the shaft journal 11, which force is transmitted via the axial roller bearing 9 to the bearing seat 6, the housing 5, and to the stator portion 1 by the impeller housing which is fixedly connected to the hull, which thus gets a forwards directed propulsion force.

The shaft 12 is a light weight shaft, which is suitably made of a composite material, with an attachment means 12E of metal (e.g. steel) at its end. The core 12B as such of the shaft is suitably made of carbon fibre, but as the shaft partly is located within the water flow, which may contain different hard objects, carbon fibre are not always a suitable surface material for such a shaft. This problem has been solved by arranging a protective sleeve 12C of glass fibre about the shaft. To give the shaft good properties to resist erosion/abrasive objects, it is preferably also provided with polyuretan as an outer surface layer 12D. A shaft of composite material of this kind is not only light but lacks also same rigidity properties as conventional shafts, above all it is considerably less rigid as to bending, which puts heavy requirements on the bearing system. Therefore, a spherical axial bearing 9 has been provided at the rear end of the shaft journal 11. As the locking ring 17 clamps the bearings 9 and 16 in this way, a rigid bearing will be obtained which may carry the bending forces created by the non-rigid shaft and by the flow, while the axial propulsion force caused by the impeller blades 14 comes through the rear axial bearing 9. Suitably the bearings are clamped so much that a minimum load occurs on the bearings, which usually implies that an axial play of max 0.05 mm, often 0–0.02 mm, is obtained, and thereby a rigid bearing is achieved. For certain applications the bearings are suitably biassed, so that the axial play always is 0 mm. In the drawing, a spherical axial bearing 9 is shown, but it is also possible to use another kind of bearing, for instance sliding bearings.

The space around the roller bodies of the bearings 9 and 16 is normally filled with oil, which is normally supplied through conduits (not shown), through a guide vane 1A, and a bearing seat 6. Therefore, said space must be sealed to water surrounding the shaft journal and the bearing seats.

By means of the present invention it has been possible to reduce the weight drastically by in the first place replacing the conventional impeller shaft by a composite shaft, which may be done because of the bearing arrangement 9, 16 in combination with the fixed connections at the end of the shaft.

Another weight reducing step being possible because of the arrangement of the bearing and the shaft according to the invention is that also the inlet 3 in the impeller housing is made of a composite material, which is coated with polyurethane 3A to obtain an impact resistant and abrasion resistant surface.

Figure 2:
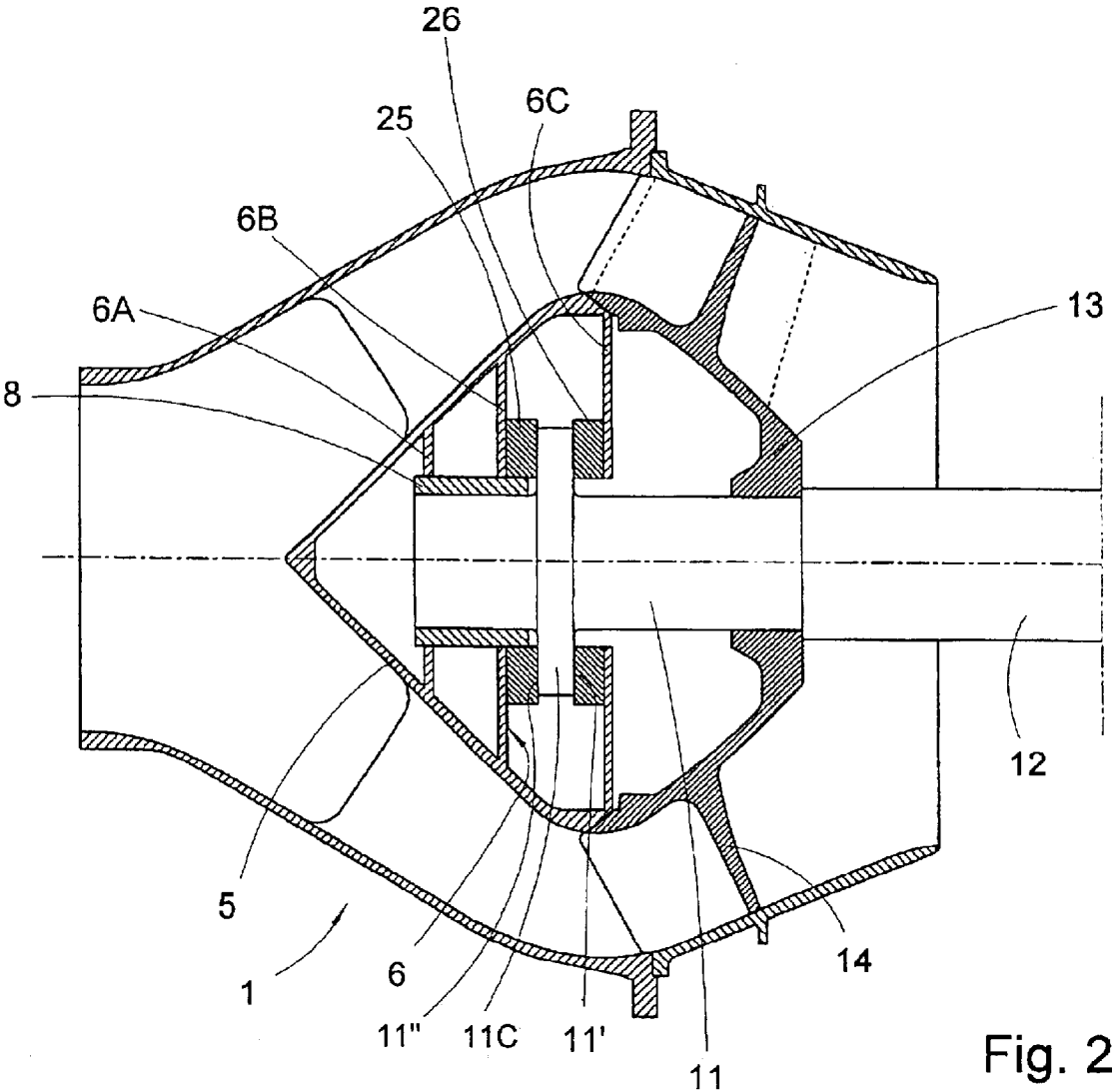
FIG. 2 is a vertical, axial cross section of an alternative embodiment of an impeller with an impeller housing according to the invention.

In FIG. 2 the above described principles according to invention are shown in a broad outline. However, it is shown a preferred principle for the bearing units. The greatest difference is that roller bearings are not used but sliding bearings. On one hand, an elongated radial bearing 8 is used, which is arranged at the rear end of the shaft journal 11 (and/or at its front end), and which is supported by radial/axial supports 6A, 6B, which are fixedly mounted within the housing 5. Further, two axial bearings/thrust bearings (25, 26) are shown, which are only intended to handle the axial forces through a flange 11C provided on the shaft journal 11. Both the rear edge portion 11A according to FIG. 1 and the flange 11B according to FIG. 2 show axially directed support surfaces 11' being able to transmit the recoil force from the impeller blades through a bearing unit 26 up to the hull. In FIG. 2 it is shown that an axial bearing 25, 26 is arranged on each side of said flange 11C, which axial bearings are provided at radial supports 6B and 6C, respectively. According to this embodiment the lubricating liquid is supplied directly by the surrounding water.

Figure 3:
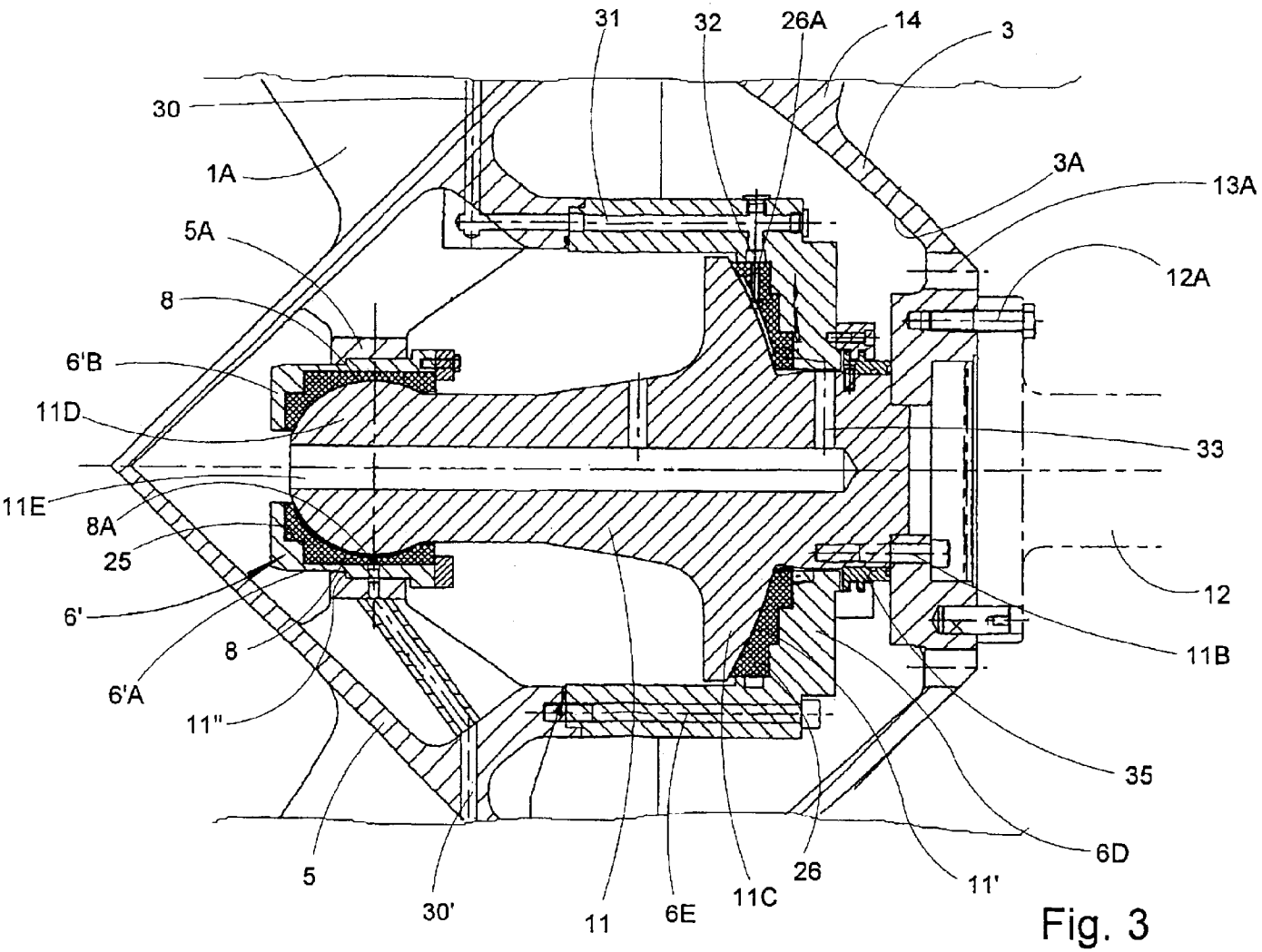
FIG. 3 shows an embodiment which is modified to a certain extent with reference to what is shown in FIG. 2.

In FIG. 3 a preferred embodiment of an arrangement is shown corresponding to the general principles shown in FIG. 2. Similar to what is shown in FIG. 2, this embodiment utilizes a flange 11C, which is intended to transmit the axial force via one of the axial sliding bearings 26. The other sliding bearing 25, for transmitting rearwardly directed axial force, forms a portion of a spherical kind of sliding bearing, which also provides for transmitting radial forces. As can be seen, the forwardly directed axial bearing 26 has an essentially larger surface than the rearwardly directed axial bearing 25, in order to optimise the bearing since during the major part of the operation time of the ship it is intended to be subjected to forward propulsion force. Further, it is shown, that the bearing housing 6D for the front bearing 26 is fixedly mounted to the stator housing 5 by means of screws 6E. As already mentioned, the rearwardly positioned bearing 25, 8 is intended for transmitting both axial and radial forces, by means of being spherically formed. The bearing 25, 8 interacts with the spherically shaped part 11D of the stub shaft 11. The housing 6' of the bearing 25, 8 comprises a cylindrical portion 6'A and a flange portion 6'B. The flange portion 6'B has as its main object to transmit the rearwardly directed forces, which in turn are transmitted to a rearwardly directed shoulder 11", which in turn interacts with an oppositely directed shoulder of a casing 5A, which is rigidly attached to the housing 5. Also the radial forces through the other portion of the bearing 8, 25 are transmitted via said casing 5A into the stator shell. FIG. 3 also shows a sealing 35, which is optional (in contrast to an oil lubricated arrangement), i.e. it may be omitted.

Because of the preferred embodiments according to FIGS. 2 and 3 of the invention bearings are obtained, which provides for a desirably high power density. Thanks to the principles of the bearing arrangement and the power transmission a high power density is obtained, which implies essential advantages with respect to many aspects, i.a. operating economy and manoeuvrability. As is evident for the skilled man the power density for the same kind of design does decrease with increased size. Accordingly it is more difficult to achieve a high power density for large water jets. It has been found that the new design does provide for power density that is at least 0,5+(2−D) kW/kg, where D is the inlet diameter of the impeller housing and D is between 0,5–2 m. In the interval where D is between 0,5–1,3 m the power density is even better, e.g. 0,7+(2−D) kW/kg. If all aspects according to the invention are combined a power density of about 2 kW/kg, may be obtained for a water jet with an inlet diameter D of 1 meter. Also for very large water jets, having an inlet diameter D above 2 m, the design according to the invention does improve the power density, but since for time being water jets in this range are very rare there does not exist any relevant figures for comparison in relation to power density within this range, where the nominal maximum design power normally is well above 15 MW.

Further, in FIG. 3 it is shown another solution for the water supply to the water lubricated units of the sliding bearings 8, 25, 26. It is shown, that a first supply conduit 30 may be provided through at least one of the guide vane 1A. Said first portion of the liquid supply runs essentially in a radial direction. At the end of said conduit 30, a axially extending conduit 31 is provided, which supplies liquid to a ring channel 32. By means of the ring channel 32 the front axial bearing is supplied with liquid from the outer periphery through appropriate openings 26A within the bearing. In a corresponding manner, the rear bearing 8, 25 is supplied with liquid through a second, substantially radially extending channel 30' into its inner surface by means of an opening 8A. It may be beneficial to arrange the housing 6' of the rear bearing 25, 8 in a slidable manner, such that, when wear occurs of the front bearing 26, a slight adjustment is allowed. Furthermore, it might be appropriate to arrange the forward directed surface 11' of the flange 11C somewhat curved. It is also shown that the shaft 11 is provided with a central bore 11E for communication with a radial channel 33 in communication with the inner periphery of the front bearing 26. The liquid, which preferably constitutes of the water in which the ship is located, is pumped (normally after appropriate filtration) at a suitable pressure, into and through the conduit 30. Further, it is shown that quite as in FIG. 1 the shaft journal is fixedly attached at the rotating impeller base 13 by means of a first screw joint 11B, while the shaft 12 is fixedly attached at the impeller base 13 by means of a second screw joint 12A.

The invention is not limited to the embodiments shown above but may be varied in different ways within the scope of the patent claims. For instance, it is realised that in some applications it might be desired to use a combination of sliding bearings and traditional bearings, wherein appropriate sealing arrangements have to be provided. It is also realised that the evacuation of water from the inner of the housing 5/base 13 might be also (or merely) be evacuated at the rear part of the non-rotating housing 5. It is evident that the sliding bearings may have varying forms, depending on different needs in different situations, as well as also the positioning and shape of the water supply channels. Moreover, it is realised that other materials having properties corresponding to carbon fibre and glass fibre, respectively, may be used in the shaft of composite material and that many different combinations of such materials may be used depending on the specific requirements. Further, it is realised that other erosion protecting coatings than polyurethane may be used, which can meet approximately the same requirements. It should also be understood, that the properties of the driving shaft may be adapted to given conditions in many different ways, above all concerning the mounting position of the different shaft bearings in front of the impeller and the water inlet, which, except influencing the natural frequency of the shaft also influences the forces transferred to the bearing arrangement, wherein the shaft bearing is preferably placed as far ahead of the bearing arrangement of the impeller housing as possible, as a definite deviation in the radial direction then results in a comparatively small angle deviation. It is realised that the principles of the sliding bearing arrangement for some applications may also advantageously be used in combination with a flexible coupling between the shaft and the impeller, and then also be used together with a conventional shaft.

Finally, the man skilled in the art realizes that the coupling joints need not be detachable. It may be conceived that the shaft 12 and the shaft journal 11 are integrated. Further, the impeller may be shrunk on the shaft and/or shaft journal, and that other similar modifications falls within the scope of the general knowledge of the man skilled in the art. Moreover it is possible to supply the lubricating liquid via the shaft.

What is claimed is:

1. A propulsion system for ships comprising an impeller, a stator shell, and an impeller housing for achieving a water jet, a shaft for the propulsion of the impeller, and a bearing arrangement for the shaft in the stator shell, wherein said bearing arrangement comprises at least one sliding bearing unit intended to carry axial load, and which sliding bearing is water lubricated, and wherein said shaft comprises a shaft journal with a flange means showing at least an axial surface for the interaction with a sliding bearing.

2. A propulsion system according to claim 1, wherein the flange means is provided with two opposite surfaces interacting with a front and a rear axial sliding bearing, respectively.

3. A propulsion system according to claim 1, wherein there is a front and rear axial sliding bearing and wherein said front sliding bearing has a considerably larger surface than said rear sliding bearing, wherein the surface of the front bearing is at least 1.5 times as large as the surface of the rear bearing.

4. A propulsion system according to claim 1, wherein said bearing arrangement comprises a radial sliding bearing, which is provided rear of at least one axial bearing unit.

5. A propulsion system according to claim 1, characterised in a conduit system for the supply of a lubricant to said sliding bearing arrangement, wherein at least one of said conduits is provided in a guide vane.

6. A propulsion system according to claim 1, wherein said shaft is made of one of metal, titanium, and hollow steel.

7. A propulsion system according to claim 1, wherein the driving force is transmitted via at least one non-flexible coupling to the stator shell, whereby no flexible coupling is used to transmit the force.

8. A propulsion system according to claim 7, wherein there is no flexible coupling for the transmission of power from the shaft to the impeller.

9. A propulsion system for ships comprising an impeller, a stator shell, and an impeller housing for achieving a water jet, a shaft for the propulsion of the impeller, and a bearing arrangement for the shaft in the stator shell, wherein said bearing arrangement comprises at least one sliding bearing unit intended to carry axial load, and which sliding bearing is water lubricated, wherein the shaft consists of a light weight shaft, which has considerably lower bending rigidity than a conventional steel shaft, and wherein said light weight shaft to an essential extent comprises a composite material.

10. A propulsion system for ships comprising an impeller, a stator shell, and an impeller housing for achieving a water jet, a shaft for the propulsion of the impeller, and a bearing arrangement for the shaft in the stator shell, wherein said bearing arrangement comprises at least one sliding bearing unit intended to carry axial load, and which sliding bearing is water lubricated, and wherein the inlet diameter D of said impeller housing is between 0.5–2 m and wherein the power density is at least 0.5+(2-D) kW/kg.

* * * * *